United States Patent [19]

Morgan, Jr. et al.

[11] Patent Number: 4,676,074

[45] Date of Patent: Jun. 30, 1987

[54] REFRIGERATION SYSTEM FOR A COUNTER-TOP OR WALL-MOUNTED VENDING MACHINE

[75] Inventors: Annis R. Morgan, Jr., Atlanta, Ga.; Bernd Mehlan, Herrieden, Fed. Rep. of Germany; Josef Gress, Bechhofen, Fed. Rep. of Germany; Hugh S. Williford, Atlanta, Ga.; Gunter Baumgartner, Herrieden, Fed. Rep. of Germany

[73] Assignee: The Coca-Cola Company, Atlanta, Ga.

[21] Appl. No.: 765,106

[22] Filed: Aug. 13, 1985

Related U.S. Application Data

[63] Continuation-in-part of Ser. No. 623,027, Jun. 21, 1984, Pat. No. 4,576,272.

[51] Int. Cl.[4] ..... F25D 25/00

[52] U.S. Cl. ..... 62/277; 62/378; 221/150 R

[58] Field of Search ..... 62/377, 277, 378, 418; 221/150 R, 150 A, 295, 301

[56] References Cited

U.S. PATENT DOCUMENTS

| | | | |
|---|---|---|---|
| 1,951,239 | 3/1934 | Friel | 221/301 X |
| 3,087,649 | 4/1963 | Leonard et al. | 221/150 R X |
| 3,110,417 | 11/1963 | Wingate et al. | 221/295 X |
| 4,485,937 | 12/1984 | Adams | 221/150 R X |

*Primary Examiner*—William E. Wayner

*Attorney, Agent, or Firm*—Birch, Stewart, Kolasch & Birch

[57] ABSTRACT

A coin-operated vending machine for bottles or cans of a moderate capacity, including a plurality of side-by-side storage chutes for feeding bottles or cans to openings in the front wall of the vending machine and a cradle in each of the openings forming a row of adjacent cradles for receiving the bottles or cans from the chutes. A refrigeration system directs chilled air by convection toward the next-to-be-vended cans in each of the cradles. The chilled air is directed by an air foil toward the cradles and the cradles have stand-off ribs therein to permit the free flow of chilled air under and around the next-to-be-vended cans.

6 Claims, 5 Drawing Figures

REFRIGERATION SYSTEM FOR A COUNTER-TOP OR WALL-MOUNTED VENDING MACHINE

This application is a continuation-in-part of application Ser. No. 623,027, filed June 21, 1984 now U.S. Pat. No. 4,576,272, which issued on Mar. 18, 1986.

BACKGROUND OF THE INVENTION

The present invention relates to a refrigerated, automatic vending machine of a low-capacity, for bottles or cans. More specifically, the present invention relates to a refrigerated, automatic, coin-operated vending machine of a suitable size for installation on a counter or as a wall console.

Heretofore, coin-operated, automatic vending machines for bottles or cans hve generally been designed to include a high storage capacity, to make them suitable for use in large, commercial establishments. Coin-operated vending machines of smaller capacities, for use in small office or low-volume sales locations have been rather simplistic in their design. These small-capacity vending machines have, for the most part, not included some of the sophisticated controls and features present in the high-capacity vending machines because of the high cost of some of these controls. However, a need in the art exists for a small-capacity, coin-operated, automatic vending machine incorporating more sophisticated controls and features than used heretofore, while maintaining a reasonable cost for each vending machine unit.

SUMMARY OF THE PRESENT INVENTION

Accordingly, it is a primary object of the present invention to provide a low-cost, low-capacity vending machine, suitable for use in low-volume vending environments.

It is another object of the present invention to provide a low-capacity vending machine, including a plurality of vend cradles for presenting a variety of selectable products to a customer.

It is still a further object of the present invention to provide an automatic vending machine with a balanced distribution of cooling through the vend chutes and the remainder of the vending machine cabinet.

It is yet another object of the present invention to provide a coin-operated vending machine of a suitable size to facilitate use on a counter top or mounting on a wall of a building.

The objects of the present invention are fulfilled by providing a convection refrigeration system for a cylindrical product vending machine comprising: a thermally insulated cooling compartment for housing the cylindrical products in side-by-side vend chutes; evaporator means included within a mechanical refrigeration assembly disposed adjacent to a rear wall of the compartment for chilling air therein; each of said vend chutes including means for storing and feeding the cylindrical products to a discharge opening in a front face of the vending machine including a pair of sidewalls, a bottom shelf between said sidewalls sloping downwardly from the rear of said chute toward the front of said chute adjacent the discharge opening, a bottom surface of said bottom shelf directing chilled air from said evaporator means toward the discharge opening, a top shelf between said sidewalls sloping downwardly from the front of said chute adjacent the front face of said vending machine toward the rear of said chute, said top shelf terminating at a point spaced from the rear of said chute by at least the diameter of the cylindrical products in the provision of a curved feed path around said top shelf to the rear of said bottom shelf, whereby said cylindrical products roll along a serpentine path beginning at the front of said top shelf and terminating at the discharge opening adjacent the front of said bottom shelf; and air foil means disposed opposite to the bottom surface of said bottom shelf for concentrating and directing chilled air toward said discharge.

BRIEF DESCRIPTION OF THE DRAWINGS

The objects of the present invention and the attendant advantages thereof will become more readily apparent by reference to the accompanying drawings wherein.

DESCRIPTION OF THE PREFERRED EMBODIMENTS

Figure 1:
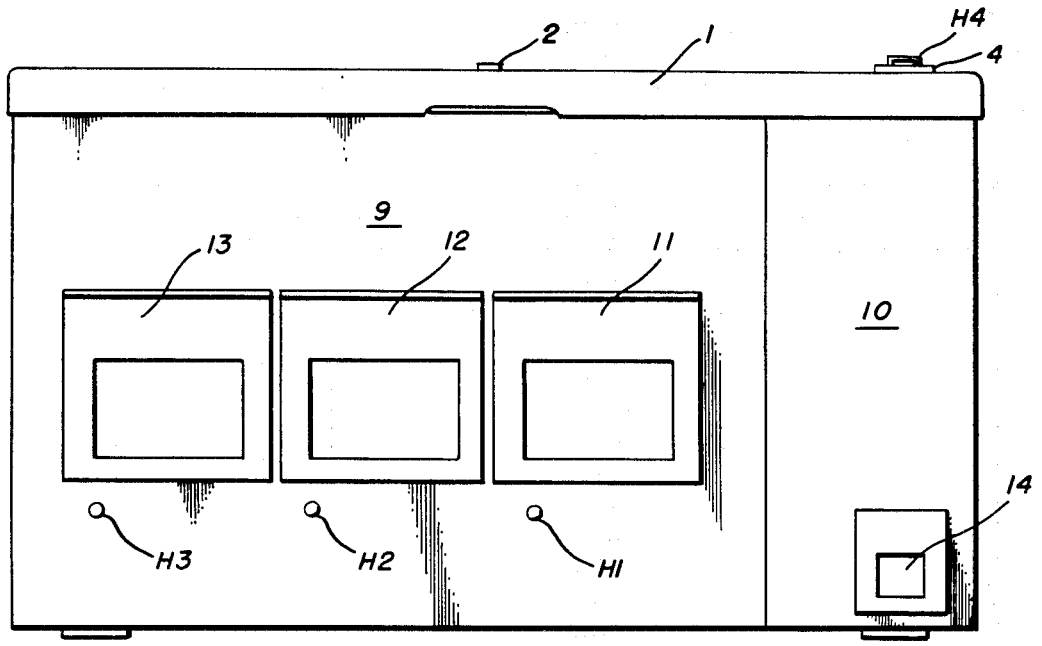
FIG. 1 is an elevational view of the automatic vending machine of the present invention.
Figure 2:
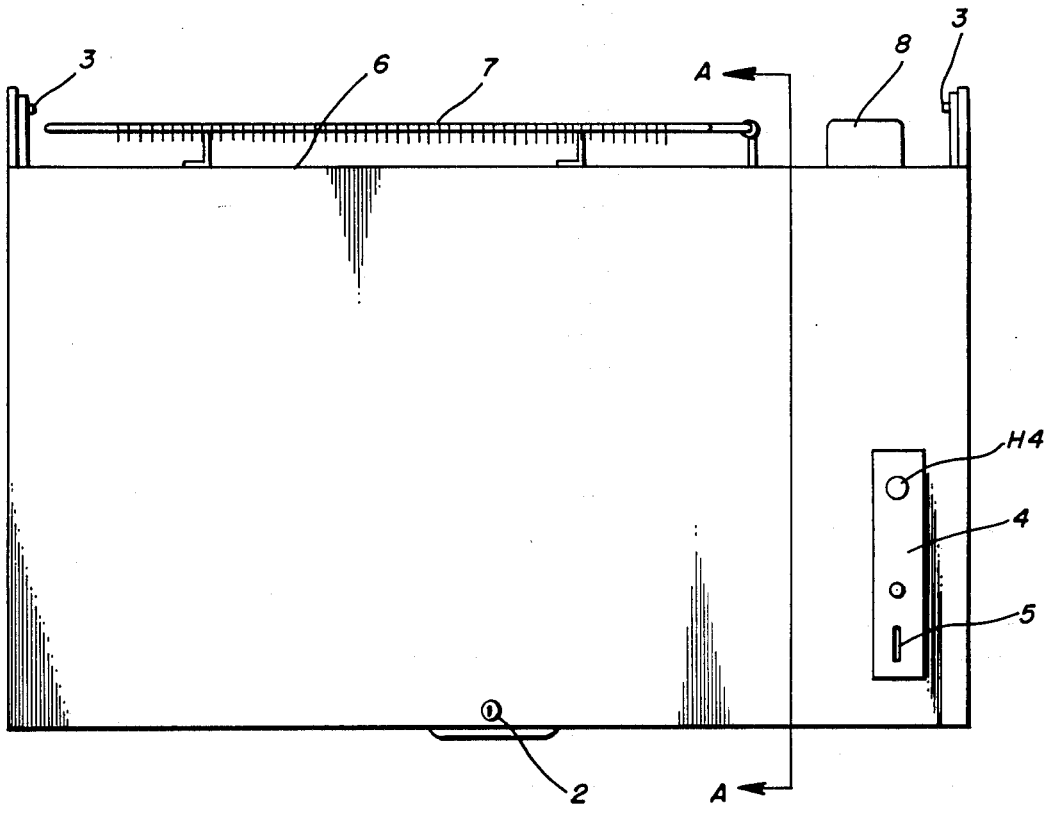
FIG. 2 is a top plan view of the automatic vending machine of FIG. 1.

Referring to FIGS. 1 and 2, the automatic vending machine of the present invention is configured in the form of a chest, whose lid 1, after opening a lock 2, can be folded upwards on hinge brackets 3. A cover plate 4 is disposed in the lid 1 and is provided with a coin slot 5.

Externally on the back wall of the automatic vending machine, a condenser 7 of a cooling unit is mounted. The compressor 8 of this unit is located adjacent the condenser 7.

The automatic vending machine chest has a front wall 9 and a door 10. In the front wall 9 are inset three cradles 11, 12 and 13. To these are attached placards indicating the various product varieties. Below the door 10 a coin return opening 14 is provided. This lies roughly underneath the coin slot 5.

Figure 3:
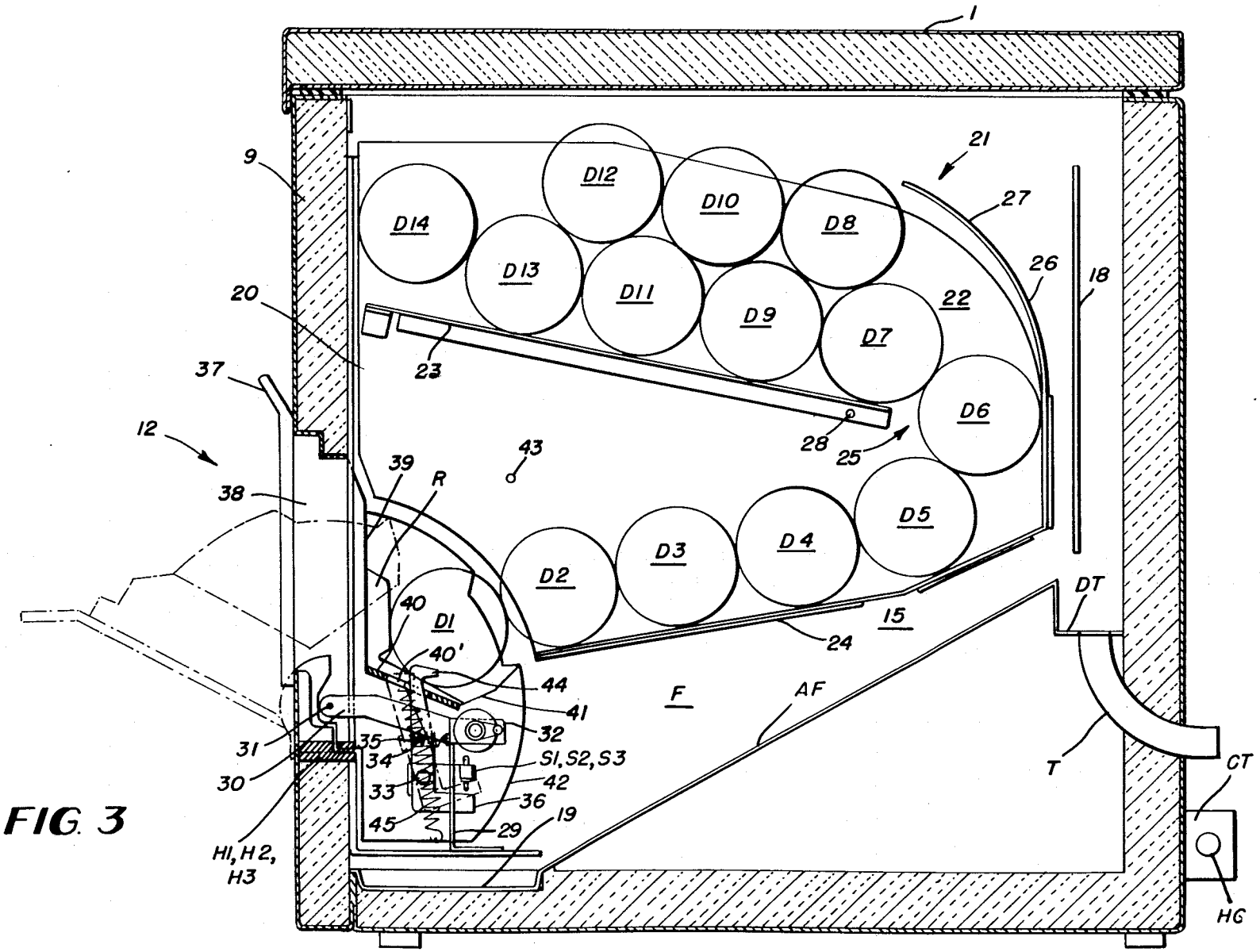
FIG. 3 is a section taken along line A—A of FIGS. 1 and 2, illustrating the cooler compartment of the automatic vending machine and one of a plurality of vend chutes and associated cradle mechanisms.

Referring to FIG. 3, behind the front wall 9 is a cooler compartment 15. Behind the door 10 is a space containing a coin control unit with a coin tester and coin changer, and a coin collector box.

Figure 5:
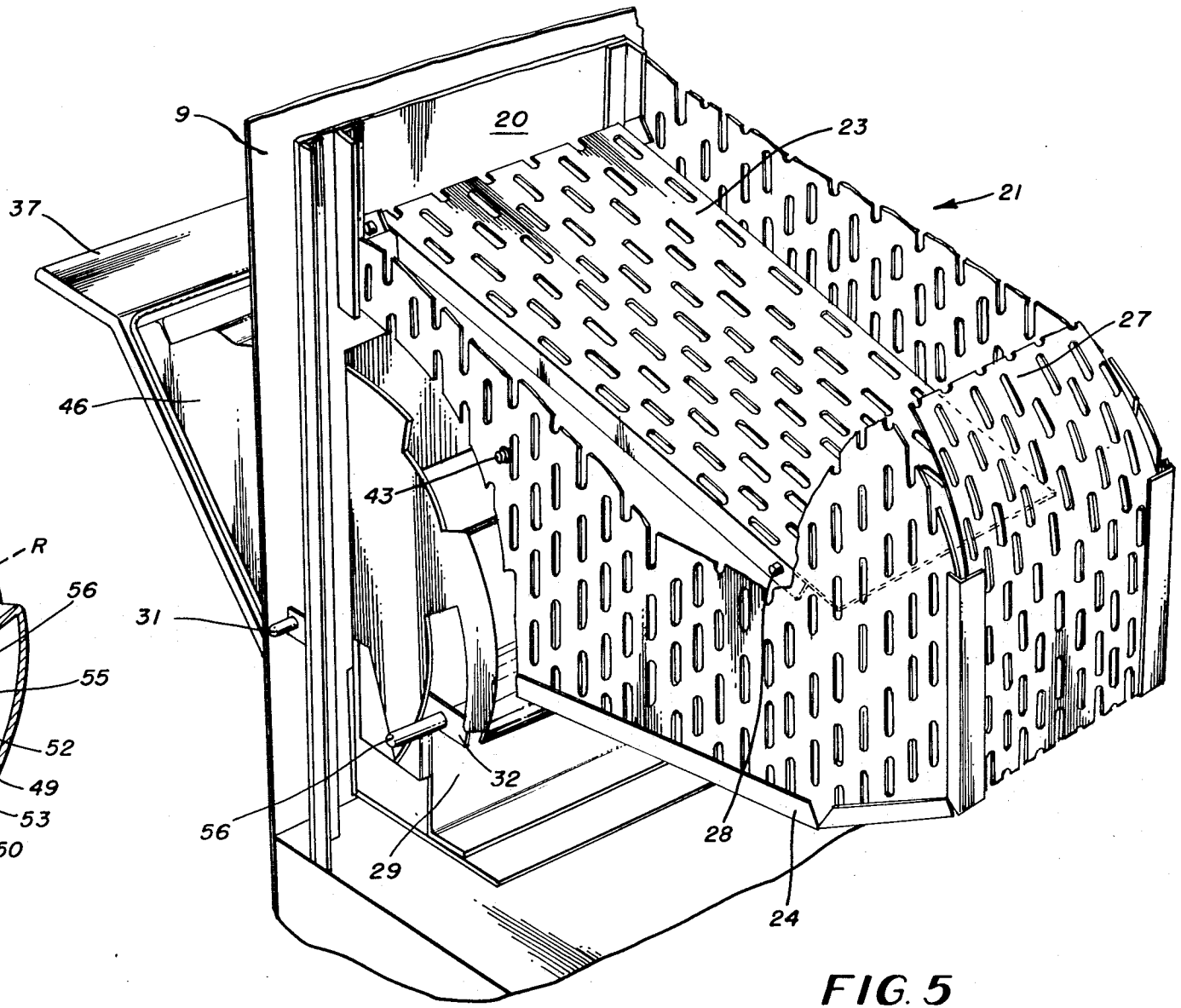
FIG. 5 is a perspective view of a vend chute for use in the vending machine of the present invention.

The cooler compartment 15 is thermally insulated on all sides. On the inside of the back wall 6 is an evaporator 18 of the cooling unit, and on the floor of the cooling compartment 15 is a drip pan 19 integrally molded with an air foil AF and an evaporator melt layer tray DT. Referring further to FIG. 3 and FIG. 5, a bearing plate 20 is attached to the inside of front wall 9. On this, a serpentine basket 21 is arranged, in which are configured alongside each other three chutes 22 operatively associated with the three cradles 11, 12 and 13. Each chute has a rearward-slanting upper shelf 23 and a frontward-slanting lower shelf 24. At the back is a passageway 25 provided with a width corresponding to the diameter of the cans D1 to D14. On lower shelf 24, the cans D2 to D5 lie in a single tier. However, a double tier of cans may be loaded thereon (see cans in dotted lines) by pivoting the upper shelf 23 about hinge pin 28 to provide access to the lower shelf 24. On the upper support plate 23, the cans D7 to D14 lie in a double tier. In order to guide the cans of the upper tier to the passageway 25, a rear wall 26 of the chute 22 is provided with a curved portion 27.

The upper shelf 23 is manually pivotable upwards around a hinge pin 28. The shelves 23 and 24 of the rear wall 26, as well as the sidewalls of the chutes 22, are fabricated out of perforated sheet metal. In this way, the cooling circulation in cooler compartment 15 is virtually unimpeded.

A mechanical support bracket 29 is attached to bearing plate 20. The bracket has hinge brackets 30 for a hinge rod 31, on which the three cradles 11, 12 and 13 are installed. The mechanical support bracket 29 is provided with further hinge brackets 32 in the vicinity of each of the cradles 11, 12 and 13. A sold-out locking lever 34, which is loaded by a spring 35, is fitted on lug 33 of mechanical support bracket 29 in the vicinity of each of the cradles 11, 12 and 13. The sold-out locking lever 34 has a switch arm 36 for the actuation of sold-out switches S1, S2 and S3 below the respective cradles.

The cradles 11, 12 and 13 are mounted so as to pivot on hinge rod 31. The cradle is shown in FIG. 3 in its closed position by continuous lines and in the open position by broken lines. Externally, the cradle 11, 12 and 13 has a pull plate 37 attached to an isolating component 38. The side of this, turned away from the pull plate 37, forms an inside surface piece 39, to which a pickup base plate 40 is attached by an obtuse angle. The pickup base plate 40 turns into a roll-on surface 41 through an obtuse angle. To this is attached a support curve 42. Above the roll-on surface 41 in the chute 22 is located a package stop 43. The details of the cradle structure are fully disclosed in U.S. Pat. No. 4,235,351 to Kolbl, et al., issued Nov. 25, 1980.

The pickup base plate 40 is provided with a slot 40' for the sold-out locking lever 34. A can lying on the pickup base plate 40, while cradles 11, 12 and 13 are in the closed position, pivots sold-out locking lever 34 against the pressure of spring 35 in the manner shown by the broken lines in FIG. 3. The sold-out locking lever 34 then actuates the corresponding sold-out switches S1, S2 and S3. If cradles 11, 12 and 13 have no can lying on pickup base plate 40, spring 35 then pulls soldout locking lever 34 in such a way that a tongue 44 formed in it engages a slot 40' so that the cradles 11, 12 and 13 can no longer be swung out and the corresponding sold-out switches S1, S2 and S3 are no longer actuated. This position of the sold-out locking lever 34 is illustrated in FIG. 3 by continuous lines. Under each cradle 11, 12 and 13, and located in front wall 9, is an indicator lamp H1, H2 and H3. These light up if the sold-out locking lever 34 does not actuate the switches S1, S2 and S3, and thus if the corresponding chute 22 is empty.

A tension spring 45, which is attached to support plate 20, acts on each cradle 11, 12 and 13. The tension spring 45 pulls the cradles 11, 12 and 13 from their open position into their closed position.

The operation of the cradles 11, 12 and 13 is fully decribed in U.S. Parent application Ser. No. 623,027, the disclosure of which is incorporated herein by reference.

FIG. 3 also illustrates the operation of the convection refrigeration system of the present invention. Air within the product compartment 15 is chilled by the evaporator 18 mounted at the top, rear of the compartment between the top and bottom walls. The chilled air tends to drop, creating convective air flow. In order to concentrate this chilled air flow toward the next-to-be-vended products in cradles 11, 12, 13, an air foil AF is provided as an integrally-molded part with the condensate drip pan 19 and an evaporator melt layer (defrost) pan DT.

Defrost tray DT has a drain tube T in fluid communication therewith, which extends through the rear wall of compartment 15. Water flows out of tray DT through tube T to a condensate tray CT. The hot gas tube from compressor 8 extends through tray CT to evaporate water therein to the atmosphere.

The shape of air foil AF is such that together with the underside of lower shelf 24, a funnel-shaped channel F is formed with focuses and concentrates the flow of chilled air toward cradles 11, 12, 13, rather than permitting the air to stagnate in the lower rear corner of the product compartment 15.

Figure 4:
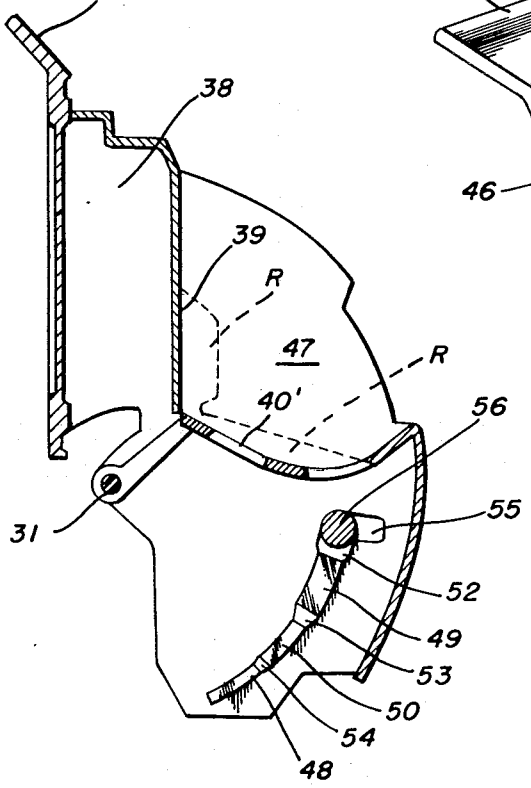
FIG. 4 is a sectional view of a cradle for use in the vending machine of the present invention illustrating stand-off ribs for enhanced product cooling.

To further increase the cooling efficiency of the next-to-be-vended products in the cradles, each cradle is provided with a plurality (preferably six) stand-off ribs R to permit air flow under and around the cans. The ribs are preferably at least 5 mm. high and are spaced about ½ inch apart. Ribs R are also shown in elevation in FIG. 4.

The configuration of the refrigeration system of the present invention, inclusive of the air foil AF and stand-off ribs R, permits adequate product pull-down and optimum serving temperatures of the next-to-be-vended products in a purely convective refrigeration system without the need for any circulating fans.

It should be understood that the system described herein may be modified, as would occur to one of ordinary skill in the art without department from the spirit and scope of the present invention.

What is claimed is:

1. A convection refrigeration system for a cylindrical product vending machine comprising:

a thermally-insulated cooling compartment for housing the cylindrical products on side-by-side vend chutes;

evaporator means included within a mechanical refrigeration assembly disposed adjacent to a rear wall of the compartment for chilling air therein;

each of said vend chutes including means for storing and feeding the cylindrical products to a discharge opening in a front of the vending machine including, a pair of sidewalls;

a bottom shelf between said sidewalls sloping downwardly from the rear of said chute toward the front of said chute adjacent the discharge opening, a bottom surface of said bottom shelf directing chilled air from said evaporator means toward the discharge opening, whereby said cylindrical products roll along a serpentine path defined by said first and second shelves, said path beginning at the front of said top shelf and terminating at the discharge opening adjacent the front of said bottom shelf; and air foil means disposed opposite to the bottom surface of said bottom shelf for concentrating and directing chilled air toward said discharge opening and the next-to-be-vended cylindrical product.

2. The system of claim 1, further including a vend cradle in each discharge opening having a support surface for the next-to-be-vended cylindrical product in the vend chute, said surface having stand-off rib means thereon to space the next-to-be-vended product therefrom, and permit chilled air to flow under and around said product.

3. The vend chute according to claim 1, wherein said sidewalls and shelves are perforated to permit the free flow of air and fluids therethrough for providing virtually unimpeded cooling circulation in said cooling compartment.

4. The system of claim 1, wherein said air foil means includes a substantially flat surface disposed opposite to the bottom surface of said bottom shelf which slopes downwardly from the rear wall of said compartment toward the front wall thereof and there is further provided a drip tray adjacent the front wall of the compartment contiguous to said air foil to receive condensation which runs down the flat surface of the air foil.

5. The system of claim 1, further including a defrost tray for said evaporator means disposed below the evaporator means adjacent the compartment rear wall, a drain tube extending from said defrost tray through the rear wall of the compartment, a condensation tray for collecting water flowing from the drain tub and a hot gas tube from a compressor in the mechanical refrigeration assembly passing through the condensation tray for evaporating water therein.

6. The system of claim 5, wherein said drip tray, air foil means and defrost tray are integrally formed from the same material.

* * * * *